US009425523B2

(12) United States Patent
Ma et al.

(10) Patent No.: US 9,425,523 B2
(45) Date of Patent: Aug. 23, 2016

(54) ELECTRICAL CONNECTOR WITH CONTACT PIN SHOULDERS

(71) Applicant: Tyco Electronics (Shanghai) Co. Ltd., Shanghai (CN)

(72) Inventors: Yongfeng Ma, Shanghai (CN); Shengyu Wu, Shanghai (CN); Jianxin Wang, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 81 days.

(21) Appl. No.: 13/974,807

(22) Filed: Aug. 23, 2013

(65) Prior Publication Data

US 2014/0045382 A1 Feb. 13, 2014

(30) Foreign Application Priority Data

Aug. 24, 2012 (CN) ..... 2012 2 0425093 U

(51) Int. Cl.

| | |
|---|---|
| ***H01R 24/00*** | (2011.01) |
| ***H01R 12/58*** | (2011.01) |
| ***H01R 12/71*** | (2011.01) |
| ***H01R 13/41*** | (2006.01) |

(52) U.S. Cl.
CPC ..... *H01R 12/585* (2013.01); *H01R 12/716* (2013.01); *H01R 13/41* (2013.01)

(58) Field of Classification Search
CPC H01R 23/7068; H01R 23/725; H01R 31/06; H05K 3/368; H05K 3/308
USPC ..... 439/626, 637, 655, 75
See application file for complete search history.

(56) References Cited

U.S. PATENT DOCUMENTS

| | | | | |
|---|---|---|---|---|
| 3,868,166 | A * | 2/1975 | Ammon | 439/634 |
| 4,156,553 | A * | 5/1979 | Ammon et al. | 439/873 |
| 4,286,837 | A * | 9/1981 | Yasutake et al. | 439/637 |
| 5,411,408 | A * | 5/1995 | DiViesti et al. | 439/326 |
| 5,478,257 | A * | 12/1995 | Cachina et al. | 439/567 |
| 6,071,152 | A * | 6/2000 | Achammer et al. | 439/733.1 |
| 6,305,949 | B1 * | 10/2001 | Okuyama et al. | 439/75 |
| 6,315,615 | B1 * | 11/2001 | Raistrick | 439/637 |
| 7,048,595 | B2 * | 5/2006 | Nakamura et al. | 439/751 |
| 8,715,009 | B2 * | 5/2014 | Wu et al. | 439/637 |

* cited by examiner

*Primary Examiner* — Hae Moon Hyeon
(74) *Attorney, Agent, or Firm* — Barley Snyder

(57) ABSTRACT

An electrical connector having a body having a shoulder receiving recess formed in a terminal end wall, and a plurality of contacts positioned in the body. Each contact has a pin projecting from a terminal end of the body. Each pin has a base with a pair of protruding shoulders.

7 Claims, 4 Drawing Sheets

ELECTRICAL CONNECTOR WITH CONTACT PIN SHOULDERS

CROSS-REFERENCE TO RELATED APPLICATION

This application claims the benefit of the filing date under 35 U.S.C. §119(a)-(d) of Chinese Patent Application No. 2012-20425093.9 filed on Aug. 24, 2012.

FIELD OF THE INVENTION

The present invention generally relates to an electrical connector, and more particularly relates to an electrical connector with pins adapted to be inserted into pin receiving passageways in a circuit board in an interference fit manner.

BACKGROUND

FIG. 1 is an illustrative perspective view of a conventional electrical connector with pins adapted to be inserted into pin receiving passageways of a circuit board in an interference fit; and FIG. 2 is a local enlarged view of a special contact holder of FIG. 1 to hold and support pins of contacts of the electrical connector.

As shown in FIG. 1, the electrical connector mainly comprises a body 10, a plurality of contacts 20 received in the body 10, and a contact holder 30 mounted on a terminal end surface of the body 10.

The contact 20 has a pin to be inserted into a circuit board (not shown) at one end thereof and a contact portion to be elastically contacted with an electrical card (not shown) at the other end thereof. A part of the contact 20 between the pin and the contact portion is received in the body 10.

As shown in FIGS. 1 and 2, the pin of the contact 20 vertically extends beyond the body 10, and the pin of the contact 20 has an enlarged base 20*a* received in a base receiving opening 30*a* of the contact holder 30 so that the pin of the contact 20 is stably held and supported by the contact holder 30 to effectively prevent the pin of the contact 20 from being deformed or bent during forcibly being inserted into the pin receiving passageway of the circuit board in an interference fit manner.

In the conventional electrical connector shown in FIG. 1 and FIG. 2, the contact holder 30 separated from the body 10 must be additionally provided to specially hold and support the contacts 20. As a result, the number of components of the electrical connector is increased, complicating the assembly work of the electrical connector, and increasing the cost of the electrical connector.

SUMMARY

The present invention has been made to overcome or alleviate at least one aspect of the above mentioned disadvantages.

Accordingly, it is therefore an object of the invention, among other objects, to provide an electrical connector having a body having a shoulder receiving recess formed in a terminal end wall, and a plurality of contacts positioned in the body. Each contact has a pin projecting from a terminal end of the body. Each pin has a base with a pair of protruding shoulders.

BRIEF DESCRIPTION OF THE DRAWINGS

The invention will now be described by way of example with reference to the accompanying figures, of which.

DETAILED DESCRIPTION

Figure 1:
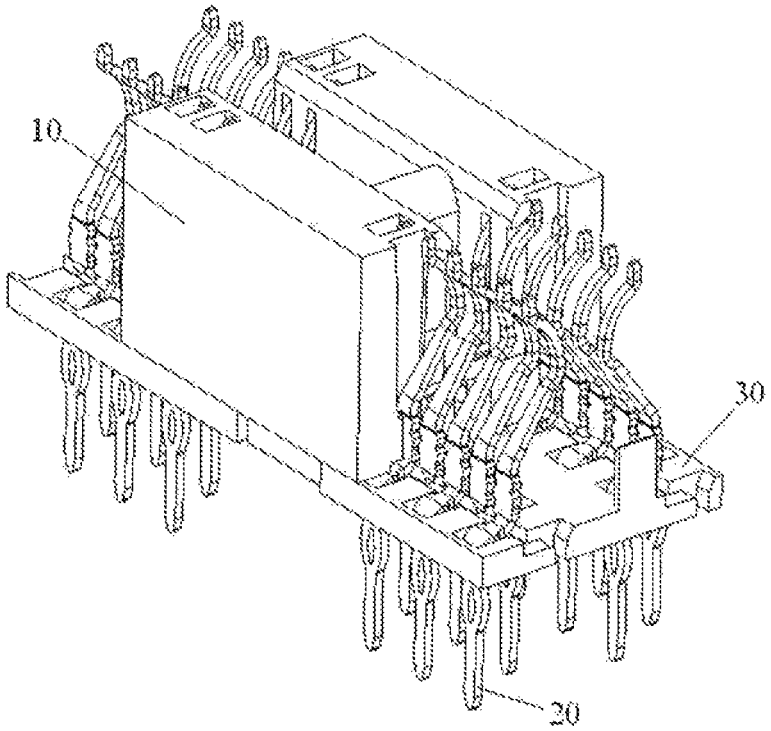
Fig. 1 PRIOR ART
FIG. 1 is a perspective view of a conventional electrical connector with pins adapted to be inserted into pin receiving passageways of a circuit board in an interference fit.
Figure 2:
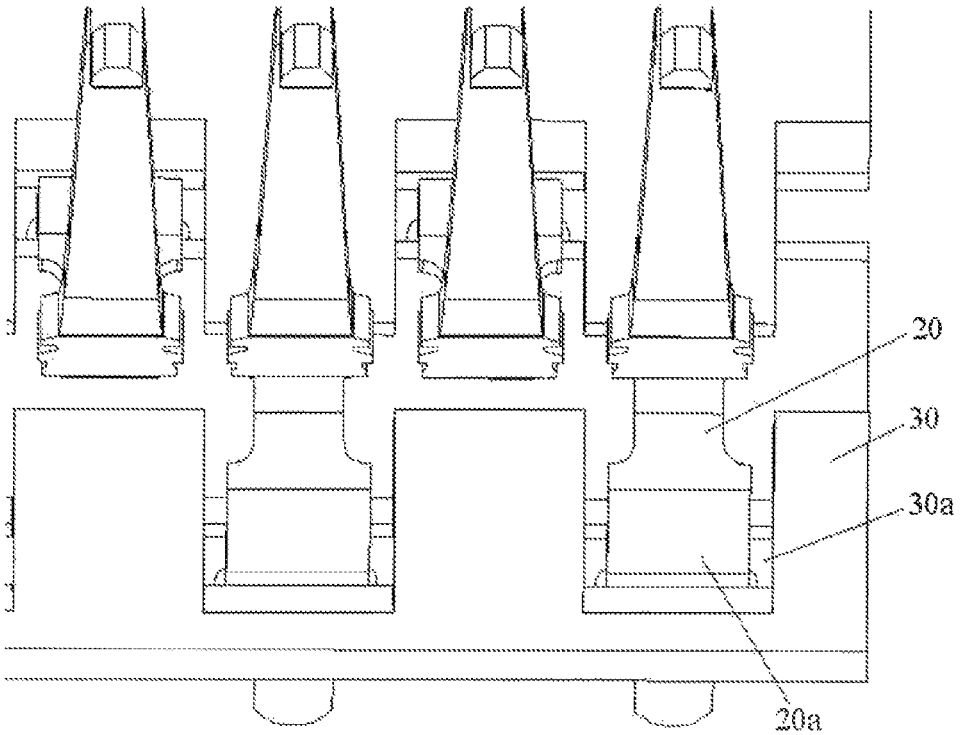
Fig. 2 PRIOR ART
FIG. 2 is an enlarged view of a special contact holder of FIG. 1 to hold and support pins of contacts of the electrical connector.

Exemplary embodiments of the invention will be described in detail with reference to the attached drawings, wherein like reference numerals refer to like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

Figure 3:
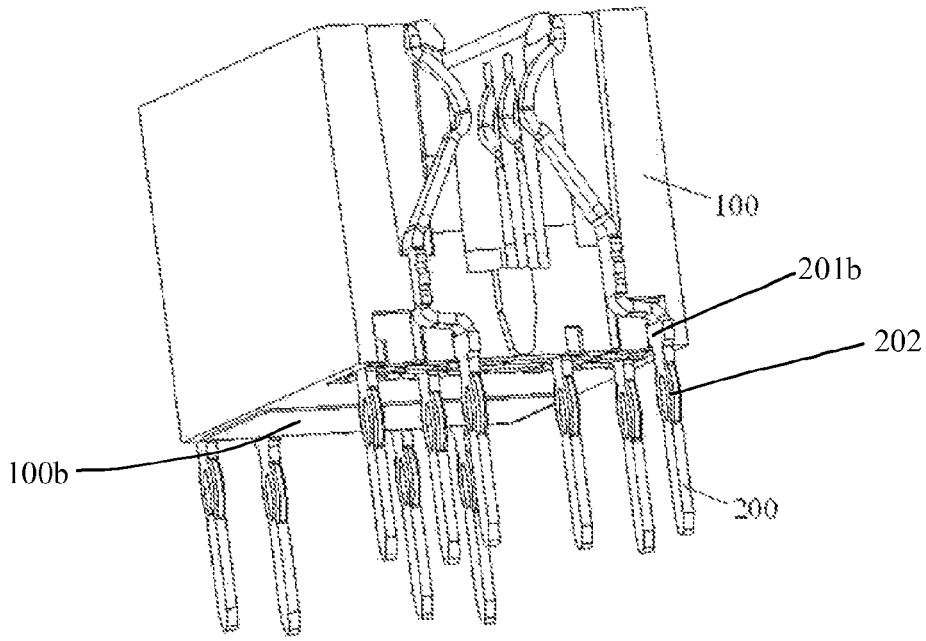
FIG. 3 is a perspective view of an electrical connector with pins adapted to be forcibly inserted into pin receiving passageways of a circuit board in an interference fit.

As shown in FIG. 3, an electrical connector has a body 100 and a plurality of contacts 200 positioned in the body 100.

In an exemplary embodiment, as shown in FIG. 3, the electrical connector comprises the body 100 and the plurality of contacts 200 received in the body 100. Accordingly, the structure of the electrical connector is very simple, and can be easily manufactured compared to the conventional electrical connector disclosed in FIG. 1, for example, by directly molding the body 100 on the plurality of contacts 200 through overmolding. The body 100 may be made of a thermoplastic material adapted to be molded, and the contacts 200 may be made of a metal material, for example, steel, copper, or other suitable conducting materials.

Figure 4:
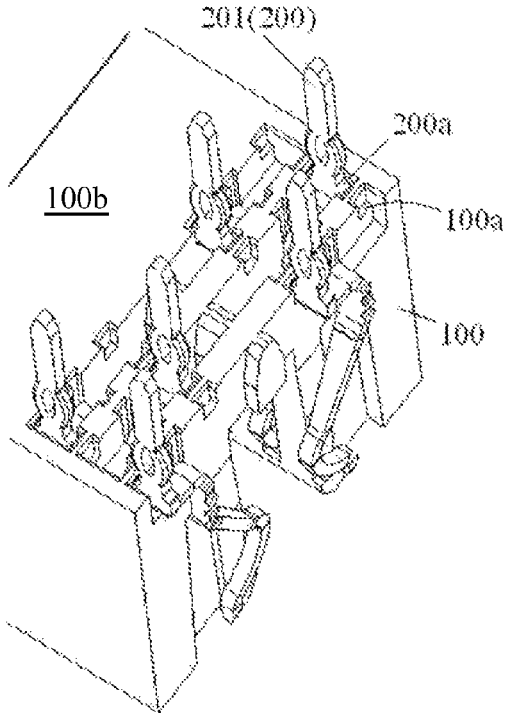
FIG. 4 is a perspective view of the electrical connector of FIG. 3 when viewing from a terminal end of the electrical connector.

As shown in FIGS. 3 and 4, each of the contacts 200 has a pin 201 vertically projecting from the terminal end of the body 100 to be inserted into a pin receiving passageway in a circuit board (not shown).

Figure 5:
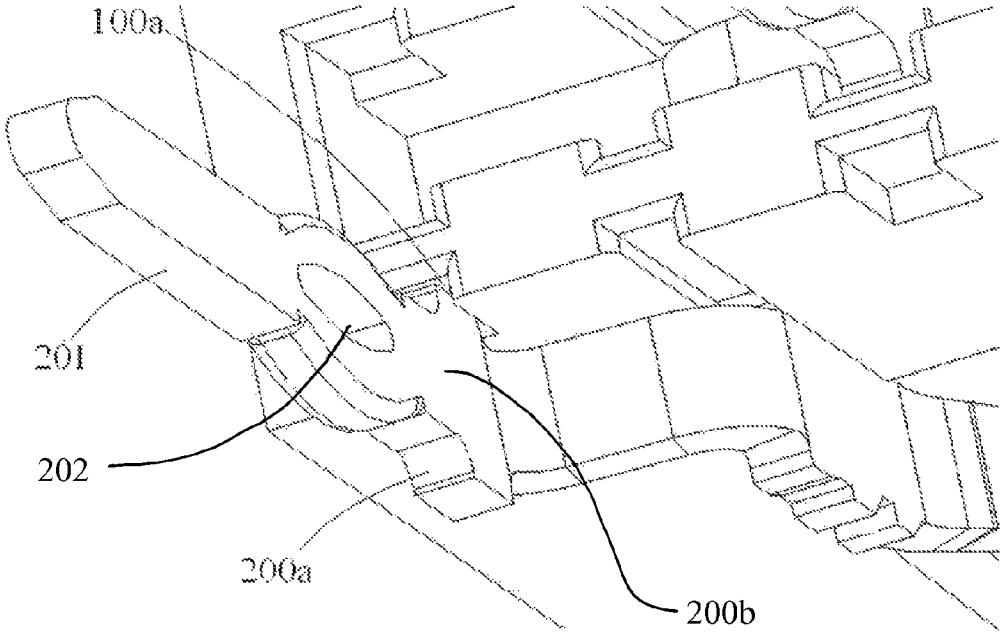
FIG. 5 is an enlarged view of a shoulder receiving recess formed in a body and a contact fitted in the shoulder receiving recess of the electrical connector of FIG. 4.
Figure 6:
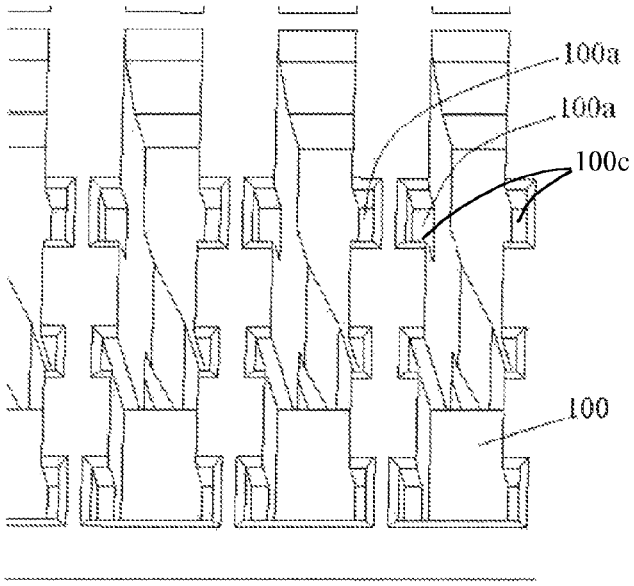
FIG. 6 is a terminal end view of a body of the electrical connector of FIG. 4 when contacts are removed from the body.

As shown in FIGS. 4-6, the pin 201 has a base 200*b* with a pair of protruding shoulders 200*a*, each shoulder 200*a* being disposed on opposite sides of the base 200*b*. The shoulders 200*a* protrude in opposite directions away from each other, in a width direction of the pin 201. The pair of shoulders 200*a* increases the bending strength of the pin 201.

Although not shown, in another exemplary embodiment, the thickness of the pin 201 can be varied to further increase or decrease the bending strength of the pin 201. For example, when the thickness of the pin 201 is increased the bending strength of the pin 201 is also increased. When the thickness of the pin 201 is decreased, the bending strength is also decreased.

As shown in FIGS. 4-6, a plurality of shoulder receiving recesses 100*a* are formed in a terminal end wall 100*b* of the body 100. The shoulders 200*a* of the pin 201 are received in the shoulder receiving recesses 100*a* such that the shoulders 200*a* of the pin 201 are held and supported in the shoulder receiving recess 100*a*. In this way, the pin 201 can be prevented from being deformed or bent during forcible insertion of the pin 201 of the contact 200 into the pin receiving passageway of the circuit board in an interference fit manner.

Referring to FIGS. 3-6, the electrical connector is configured so that the pins 201 of the contacts 200 are held and supported by only shoulder receiving recesses 100*a* directly formed in the body 100 of the electrical connector, instead of by a special contact holder separated from the body 100. That is, the electrical connector of the present invention is not additionally provided with a contact holder to specially hold and support the pins 201 of the contacts 200.

Since the shoulders 200*a* of the pins 201 of the contacts 200 are held and supported by the shoulder receiving recesses 100*a* directly formed in the terminal end wall of the body 100, the need for an additional contact holder for specially holding and supporting the pins of the contacts in the conventional electrical connector is eliminated. As a result, the number of components of the electrical connector is reduced, simplifying the assembly and decreasing the cost of the electrical connector.

In order to reliably hold and support the shoulder 200*a*, in an exemplary embodiment, the shoulder 200*a* is tightly fitted in the shoulder receiving recess 100*a* to prevent the displacement of the pin 201 in the width direction or the thickness direction. However, in another embodiment, a small gap is positioned between the shoulder 200*a* and the shoulder receiving recess 100*a*, so that the contact can be adjusted in a certain range to complement any manufacturing tolerances arising during the manufacture of the circuit board. In this way, the pins 201 can be more easily inserted into the pin receiving passageways of the circuit board.

In an exemplary embodiment shown in FIGS. 3-6, the shoulder 200*a* abuts against a terminal end surface 100*c* of the shoulder receiving recess 100*a*. In this way, an external force for inserting the pins 201 of the electrical connector into the pin receiving passageways of the circuit board is transferred along a longitudinal axis to the inserted shoulder 200*a* directly by the terminal end surface 100*c* of the shoulder receiving recess 100*a*. Since the external force is exerted along a longitudinal axis to the inserted shoulder 200*a*, the pin 201 is prevented from being twisted and bent as a tangentially applied force would do to the pin 201.

In an exemplary embodiment shown in FIGS. 3-6, the pin 201 has a flat shape. Further, the pin 201 has an eyelet portion 202 inserted into the pin receiving passageway of the circuit board in an interference fit manner. Accordingly, a reliable electrical connection can be achieved between the pin receiving passageway of the circuit board and the pin 201.

In an exemplary embodiment, the pin 201 of the contact 200 is substantially perpendicular to the circuit board and inserted into the pin receiving passageway of the circuit board in a press fit manner.

In another exemplary embodiment, the electrical connector is a press fit connector for a memory bank. When the pin 201 is inserted into the pin receiving passageway of the circuit board and when the memory bank is inserted into the electrical connector, the memory bank is electrically connected to the circuit board through the electrical connector.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. An electrical connector, comprising:

a body having a shoulder receiving recess formed in a terminal end wall; and a plurality of contacts positioned in the body, each contact having a pin projecting from the terminal end wall of the body, the pin having a base with a pair of protruding shoulders;

wherein the shoulders are positioned in the shoulder receiving recess and abut a terminal end surface of the shoulder receiving recess in a direction opposite to an insertion direction of the pins into a circuit board, and the width of the shoulders is approximately equal to the width of the shoulder receiving recess.

2. The electrical connector according to claim 1, wherein the pin is flat.

3. The electrical connector according to claim 1, wherein the pin further comprises an eyelet portion engageable with a pin receiving passageway of the circuit board.

4. The electrical connector according to claim 3, wherein the eyelet portion engages with the pin receiving passageway by an interference fit.

5. The electrical connector according to claim 1, wherein the pin is press fitted into a pin receiving passageway of the circuit board.

6. The electrical connector according to claim 1, wherein the pins are held and supported by the shoulder receiving recesses of the body.

7. The electrical connector according to claim 1, wherein the electrical connector is a press fit connector for a memory bank.

* * * * *